US010792721B1

(12) United States Patent
Danby et al.

(10) Patent No.: US 10,792,721 B1
(45) Date of Patent: Oct. 6, 2020

(54) METHOD FOR MANUFACTURING A WORK PIECE

(71) Applicant: A. Raymond et Cie, Grenoble (FR)

(72) Inventors: Mike Danby, Stoney Creek (CA); Stefan Schulz, Baden-Wuerttemberg (DE); Isabella Barrett, Clio, MI (US); Jan Peter Stickelberger, Baden-Wuerttemberg (DE)

(73) Assignee: A. Raymond et Cie, Grenoble (FR)

( * ) Notice: Subject to any disclaimer, the term of this patent is extended or adjusted under 35 U.S.C. 154(b) by 0 days.

(21) Appl. No.: 16/788,651

(22) Filed: Feb. 12, 2020

(51) Int. Cl.
*B21D 22/02* (2006.01)
*B21D 22/30* (2006.01)

(52) U.S. Cl.
CPC ..... *B21D 22/02* (2013.01); *B21D 22/025* (2013.01); *B21D 22/30* (2013.01)

(58) Field of Classification Search
CPC ..... B21D 22/02; B21D 22/025; B21D 22/20; B21D 22/26; B21D 22/28; B21D 22/30; B21D 28/28; B21D 53/24; B21D 24/005; B21D 35/001
See application file for complete search history.

(56) References Cited

U.S. PATENT DOCUMENTS 1,383,747 A * 7/1921 Noble ..... B21K 1/20 29/888.451
3,685,337 A * 8/1972 Avitzur ..... B21D 22/20 72/347
3,731,369 A * 5/1973 Johnson ..... B21D 39/032 29/509
3,924,437 A * 12/1975 Hortig ..... B21D 22/20 72/349
3,945,231 A * 3/1976 Imazu ..... B21D 22/20 72/45
4,070,895 A * 1/1978 Yamada ..... B21D 53/10 29/888.44
4,423,616 A * 1/1984 Pease ..... B29C 70/682 72/348
4,559,802 A * 12/1985 Budrean ..... B21D 22/28 72/325
5,083,449 A * 1/1992 Kobayashi ..... B21D 51/26 72/349
5,249,447 A * 10/1993 Aizawa ..... B21D 22/201 72/349
5,910,052 A * 6/1999 Ellis ..... B21D 22/206 470/6
6,568,064 B2 * 5/2003 Kanno ..... H02K 1/17 29/596
9,689,420 B2 6/2017 Ortega Dona
2015/0093591 A1 * 4/2015 Walde ..... B21D 22/21 428/603

* cited by examiner

*Primary Examiner* — Edward T Tolan
(74) *Attorney, Agent, or Firm* — Warner Norcross + Judd LLP

(57) ABSTRACT

The present disclosure provides a method for manufacturing a work piece, such as fasteners or flange nuts. The method produces a work piece with a thickened wall. This can be accomplished using a plurality of successive stamping dies to reduce the diameter of a cup-shaped feature drawn from a blank, and reforming the cup-shaped feature to a formed shape having a thickened wall. A fastener or flange nut with a thickened wall manufactured by stamping and forming is also disclosed.

25 Claims, 5 Drawing Sheets

METHOD FOR MANUFACTURING A WORK PIECE

FIELD OF THE INVENTION

The present disclosure generally relates to method for manufacturing work pieces, such as fasteners or flange nuts.

DESCRIPTION OF THE RELATED ART

Fasteners are used in many applications to, for example, fasten components to one another. One common type of fastener is a flange nut, where the flange acts as an integrated washer.

Today's fasteners often come in contact with non-compatible materials and/or mating surfaces in which contact corrosion is an issue. Inherently, fasteners in contact with dissimilar materials can become mechanically weak. When using fasteners made of similar materials, contact corrosion can be avoided. However, this limits where fasteners can be applied.

A solution to fasteners lacking mechanical strength and/or having limited applicability is needed.

SUMMARY OF THE INVENTION

A method for manufacturing a work piece is provided herein. In an exemplary embodiment, the method includes providing a non-ferrous blank having a first thickness, stamping the blank a first time using a first stamping die to draw a portion of the blank into a cup-shaped feature having a first diameter and a first top radius, stamping the blank a plurality of additional times using a plurality of successive stamping dies to reduce the diameter of the cup-shaped feature from the first diameter to a second diameter and to reduce the top radius of the cup-shaped feature from the first top radius to a second top radius, and reforming the cup-shaped feature having the second diameter at a forming station to a formed shape having a thickened wall. The thickened wall of the formed shape can have a second thickness that is greater than the first thickness of the blank.

In certain embodiments, the diameter of the cup-shaped feature is reduced by at least 15% by each successive stamping die.

In certain embodiments, the blank is stamped at least eight additional times using at least eight successive stamping dies to reduce the diameter of the cup-shaped feature from the first diameter to the second diameter, and to reduce the top radius of the cup-shaped feature from the first top radius to a second top radius.

These and other features and advantages of the present disclosure will become apparent from the following description of particular embodiments, when viewed in accordance with the accompanying drawings and appended claims.

DETAILED DESCRIPTION OF THE INVENTION

A manufacturing method is described below. As will be appreciated from the description here, the method has multiple applications, but is generally used as a method for manufacturing a work piece, such as fasteners or flange nuts. It is to be understood that the method may be used to manufacture other parts, such as washers and other nuts. At least some embodiments of the method provided herein produces a work piece with a thickened wall. This can be accomplished through the various steps thereof, as described below, including stamping a blank a plurality of times using a plurality of successive stamping dies. In another aspect, a stamping press and a set of dies for making a work piece, such as fasteners or flange nuts with a thickened wall is described below. Still another aspect relates to a fastener or flange nut with a thickened wall manufactured by stamping and forming.

Figure 1:
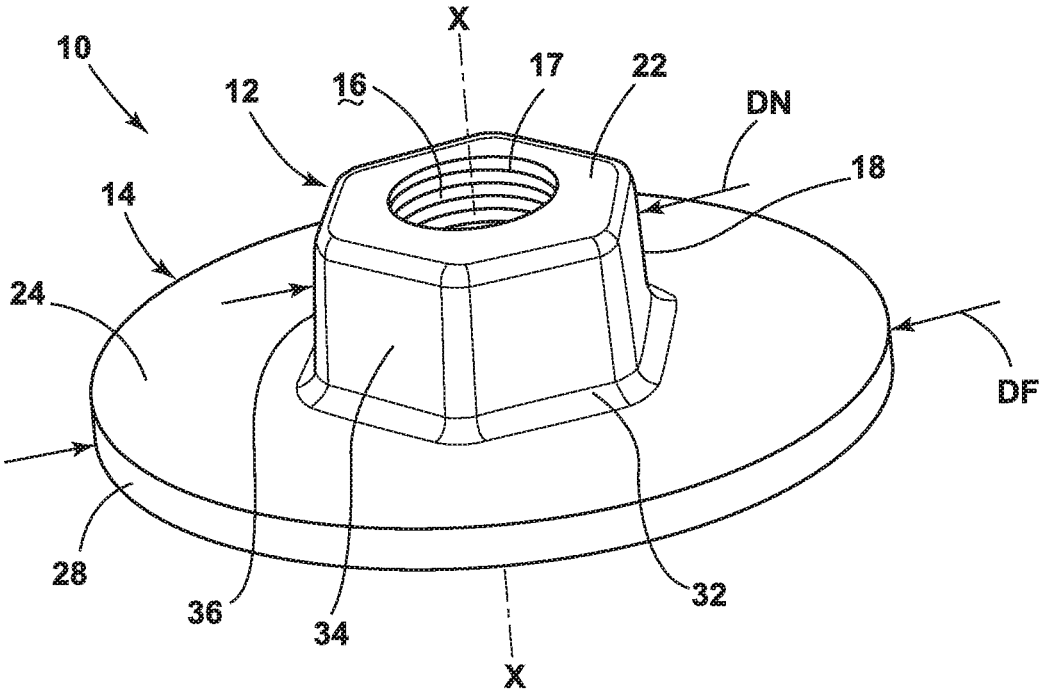
FIG. 1 is a perspective view of a work piece according to one embodiment of the invention.
Figure 2:
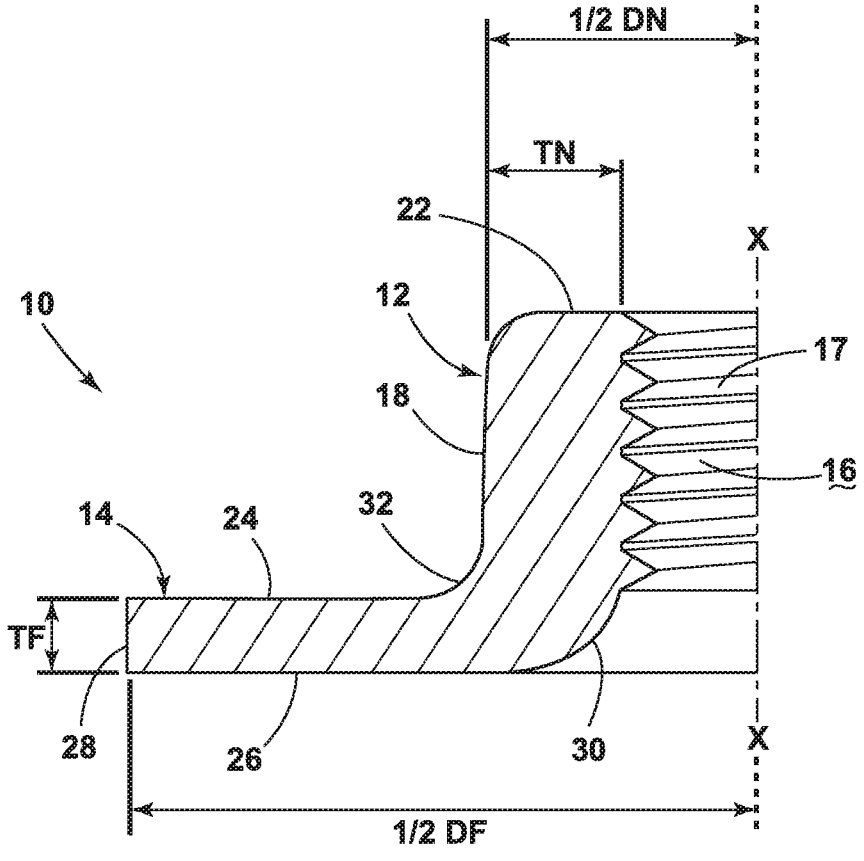
FIG. 2 is a cross-sectional view of the work piece of FIG. 1.

In FIGS. 1-2, a work piece according to a first embodiment of the invention is illustrated and generally designated 10. The work piece 10 can include a nut 12 and a flange 14. The flange 14 can be disposed at about 90 degrees, i.e. a right angle, with respect to the nut 12. The work piece 10 as shown comprises a fastener, and more particularly a flange nut, with the flange 14 acting as an integrated washer. The work piece 10 can include a longitudinal axis X, with the nut 12 arranged on the longitudinal axis X and the flange 14 extending generally radially relative to the longitudinal axis X.

The work piece 10 can be a unitary, one-piece stamped and formed element. The work piece 10 can be manufactured from flat metal stock, such as, but not limited to, non-ferrous materials. Examples of non-ferrous materials suitable for the work piece 10 include, but are not limiting to, aluminum, brass, copper, and alloys thereof. The non-ferrous material can be cold-formed under application of pressure at a temperature below its recrystallization temperature, such as at ambient or room temperature.

The nut 12 can include a central opening 16 through which a screw, bolt, or other part comprising a shaft can be inserted. The central opening 16 can include threads 17 sized to mate with corresponding threads on the screw, bolt, or other part comprising a shaft.

The nut 12 can include an outer surface 18 and an inner surface 20 opposite the outer surface 18, which defines the central opening 16 through the work piece 10 and comprises the threads 17. The outer and inner surfaces 18, 20 can meet at a top edge or surface 22.

The outer surface 18 of the nut 12 can be configured to be by engaged by a tool. In one example, the outer surface 18 can have a hexagonal shape, with six planar surfaces 34 joined at six edges 36, to mate with a wrench or other tool. Other shapes for the outer surface 18 are possible.

The nut 12 has a diameter DN. The diameter DN can be an outer diameter defined by the outer surface 18 and generally measured orthogonal to the longitudinal axis X, between opposing points on the outer surface 18. With the hex nut 12, the diameter DN can be measured orthogonal to the longitudinal axis X, between opposing edges 36 of the outer surface 18.

The flange 14 can include an upper surface 24, a lower surface 26 opposite the upper surface 24, and an outer edge 28. The lower surface 26 can define a lower or lowermost surface of the work piece 10. The outer edge 28 can define a diameter DF of the flange 14. The flange 14 can be circular as shown. Other shapes for the flange 14 are possible.

The flange 14 can have a larger diameter than the nut 12 (i.e., DF>DN), which serves to distribute the pressure of the nut 12 over the part being secured by the work piece 10. While not shown, the flange 14 can have serrations on the lower surface 26, which can provide a locking action to keep the work piece 10 from rotating a direction that would loosen the nut 12.

The work piece 10 can feature a varying wall thickness. The nut 12 can comprise a wall thickness TN, which can be measured between the outer and inner surfaces 18, 20 of the nut 12. The flange 14 can comprise a flange thickness TF, which can be measured between the upper and lower surfaces 24, 26 of the flange 14. As shown in FIG. 2, the nut 12 can have greater wall thickness than the flange 14 (i.e. TN>TF). Varying the wall thickness increases strength in localized areas.

The inner surface 20 of the nut 12 can meet the lower surface 26 of the flange 14 at an outer corner 30. The outer surface 18 of the nut 12 can meet the upper surface 24 of the flange 14 at an inner corner 32. The work piece 10 can have a radiused edge at the outer corner 30 and/or a radiused edge at the inner corner 32. Radiused edges increase the strength and load capacity of the work piece 10, as compared with a part having sharp edges at these locations. Therefore, there is less stress concentration at the outer and inner corners 30, 32 of the work piece 10.

Figure 3:
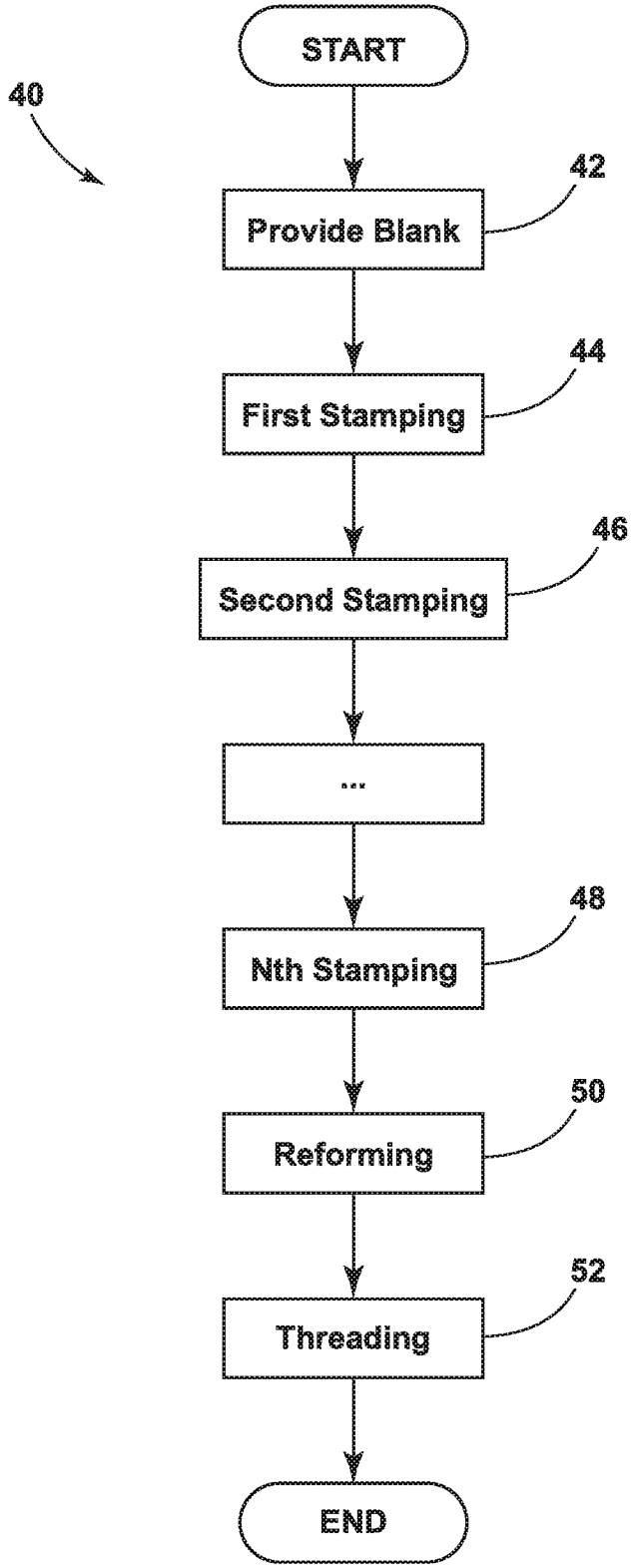
FIG. 3 is a flow chart showing a method for manufacturing a work piece, according to another embodiment of the invention.

FIG. 3 is a flow chart showing a method 40 for manufacturing a work piece according to another embodiment of the invention. The sequence of steps discussed is for illustrative purposes only and is not meant to limit the method in any way as it is understood that the steps may proceed in a different logical order, additional or intervening steps may be included, or described steps may be divided into multiple steps, without detracting from the invention. The method 40 is described with respect to the work piece 10 shown in FIGS. 1-2, although it is understood that the method 40 can be used to form other work pieces.

In general, stamping or drawing is used to form the general shape of the work piece 10 first, and is followed by one or more forming operations employed to form the final shape of the work piece 10. The method 40 can be a cold-forming process that makes use of dies and stamping presses to transform non-ferrous sheet metal into the work piece 10. Pressure is applied to non-ferrous sheet metal at a temperature below its recrystallization temperature, such as at ambient or room temperature, to transform the shape of the sheet metal. The method 40 is suitable to make non-ferrous sheet metal parts that have a thickened wall, such as the fastener shown in FIGS. 1-2 having a thickened wall for the nut 12 and a thinner flange 14.

The method 40 can include a step 42 of providing a blank, optionally a non-ferrous blank, having a first thickness, a step 44 of stamping the blank using a first stamping die to draw a portion of the blank into a cup-shaped feature, steps 46, 48 of stamping the blank a plurality of additional times using a plurality of successive stamping dies to reduce the diameter of the cup-shaped feature, and a step 50 of reforming the cup-shaped feature at a forming station to a formed shape having a thickened wall. The thickened wall of the formed shape can have a thickness that is greater than an original thickness of the blank. The method 40 can optionally comprise a step 52 of forming threads on the formed shape.

The method 40 can optionally include performing other operations on the formed work piece 10 as well, such as heat treating, applying a coating, or surface finishing the formed work piece 10 to achieve desired properties, such as improving corrosion resistance, wear resistance, or hardness. In one embodiment, the heat treating operation can including heating the work piece 10 to a high temperature and then cooling the work piece 10 in water. The work piece 10 can then be aged in a furnace. The coating or finishing operation can be performed after the heat treatment is applied to the work piece 10.

Figure 4:
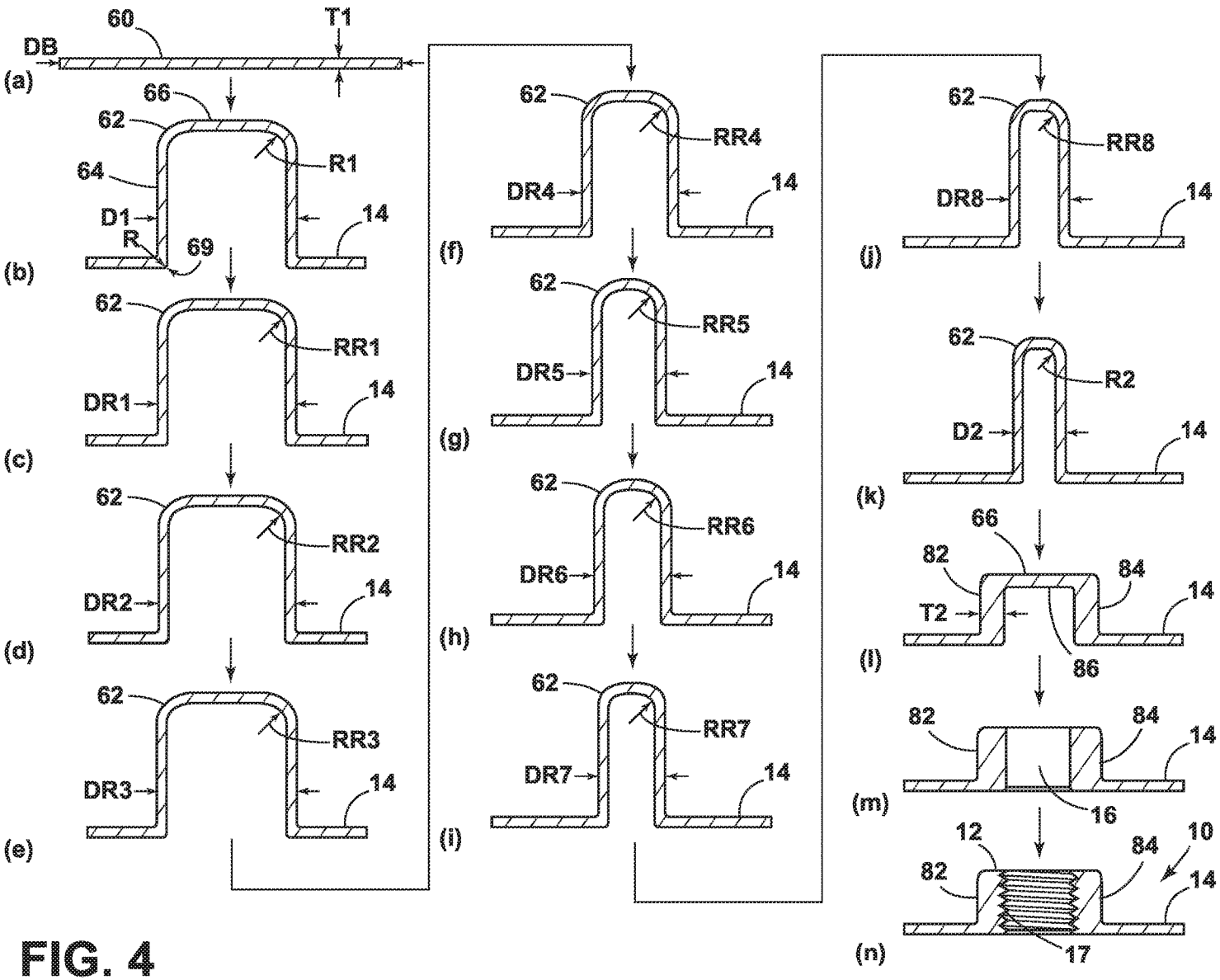
FIG. 4 is a schematic illustration of the sequential steps of a method for manufacturing a work piece from a blank, according to yet another embodiment of the invention.

FIG. 4 shows one embodiment of the successive steps for manufacturing the work piece 10 according to method 40, including successive stages of stamping a blank to reduce the diameter of the cup-shaped feature. While described herein with respect to the work piece 10 of FIGS. 1-2, the method 40 can be applied to other fastening elements that are loaded with tensile, torsional, or compressive stresses.

The method 40 can begin with (a) providing a blank 60 having a first thickness T1. The blank 60 can comprise a flat sheet of metal that can have generally uniform thickness. The blank 60 can have a diameter DB.

As part of the step of providing the blank 60, the blank 60 can be formed by a blanking operation. A sheet of material can be cut to a closed contour, such as the circular shape shown in FIG. 4, by subjecting the sheet to shear stresses between a punch and die. With the blanking operation, and piece of sheet metal that is punched out becomes the blank 60 having diameter DB.

The blank 60 can comprise a non-ferrous material. Examples of non-ferrous materials suitable for the blank include, but are not limiting to, aluminum, brass, copper, and alloys thereof. Other metals or metal alloys can be used.

Next, at (b) the blank 60 is stamped a first time using a first stamping die to draw a portion of the blank 60 into a cup-shaped feature 62. As shown in further detail in FIG. 5, the cup-shaped feature 62 can have a first diameter D1 measured with respect to a centerline, e.g. the longitudinal axis X, of the cup-shaped feature 62, and a first top radius R1 measured at the top end of the cup-shaped feature 62.

The first diameter D1 is based on the volume of material for the final formed shape 82 of the work piece 10. In other words, the volume of material for the final formed shape 82 of the work piece 10 dictates the first diameter D1. In particular, the first diameter D1 can be selected such that the cup-shaped feature 62 formed by the first draw has the same volume of material as the final formed shape 82.

In addition to the cup-shaped feature 62, stamping the blank 60 can form the flange 14. The flange 14 as formed by the first stamping can have a thickness TF and a diameter DF1. The flange thickness TF can be the same, or about the same, as the original thickness T1 of the blank 60. Generally, the flange thickness TF can remain constant throughout the die progression steps.

The flange diameter DF1 can be is significantly less than the diameter DB of the blank 60, as blank material is drawn into the cup-shaped feature 62. The flange diameter DF1 can remain constant throughout the subsequent stamping steps, although small changes in flange diameter due to subsequent stamping steps are possible. The flange diameter DF1 can be about equal to the flange diameter DF of the finished work piece, the flange diameter DF can be less than flange diameter DF1. For example, the flange 14 of the finished work piece 10 can be stamped to a specified diameter DF after the cold-forming process.

The cup-shaped feature 62 can comprises a tubular sidewall 64 and a closed end wall 66. The flange 14 can be disposed at about 90 degrees, i.e. a right angle, with respect to the tubular sidewall 64. As described in further detail below, the cup-shaped feature 62 can be shaped by further steps of the method to form the nut 12 of the work piece 10.

The first diameter D1 can be an outer diameter defined by the sidewall 64 and generally measured orthogonal to the centerline or longitudinal axis X, between opposing points on the outer surface of the sidewall 64.

In one embodiment, the first top radius R1 can be the radius of the largest circle (shown in phantom line in FIG. 5) that is tangent to both the sidewall 64 and the end wall 66 of the cup-shaped feature 62. As shown, the sidewall 64 can meet the closed end wall 66 at a corner 68, which can be rounded or radiused. The first top radius R1 can be an inside radius measured at the corner 68, i.e. where the closed end wall 66 meets the sidewall 64.

Figure 5:
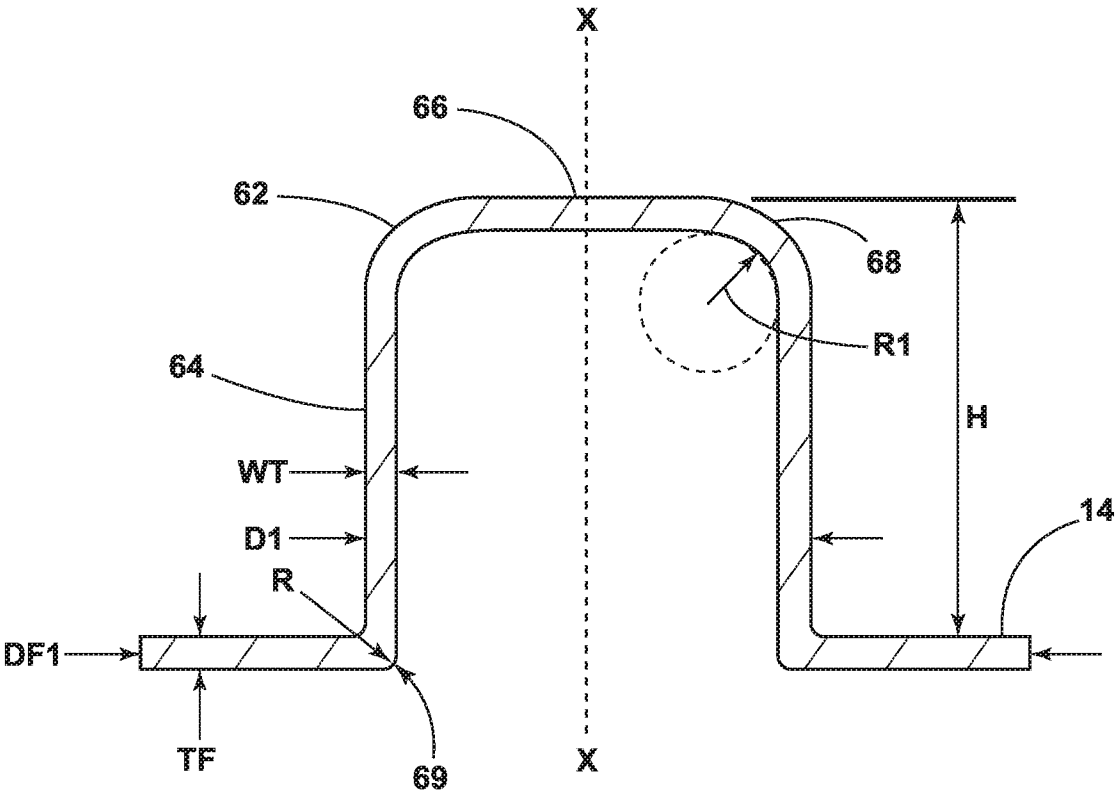
FIG. 5 is a cross-sectional view showing the blank after a first stamping to form a cup-shaped feature.

As shown in further detail in FIG. 5, the cup-shaped feature 62 can have a bottom radius R measured at the bottom end of the cup-shaped feature 62. In addition to the cup-shaped feature 62 and the flange 14, stamping the blank 60 can form a corner 69 between the flange 14 and the tubular sidewall 64 of the cup-shaped feature 62. The corner 69 can be rounded or radiused. The bottom radius R can be an outside radius measured at the corner 69, i.e. where the sidewall 64 meets the flange 14. In one embodiment, the bottom radius R can be the radius of the largest circle that is tangent to both the sidewall 64 meets the flange 14.

The non-ferrous material can be thinner at the corners 68, 69 than at the sidewall 64, i.e. the corners 68, 69 can have a thickness less than WT. The thickness of the corners 68, 69 are not necessarily the same.

The cup-shaped feature 62 can have other dimensions defining its shape, including a height H measured along the longitudinal axis X as the distance from the flange 14 to the closed end wall 66, and a wall thickness WT of the sidewall 64.

Figure 7:
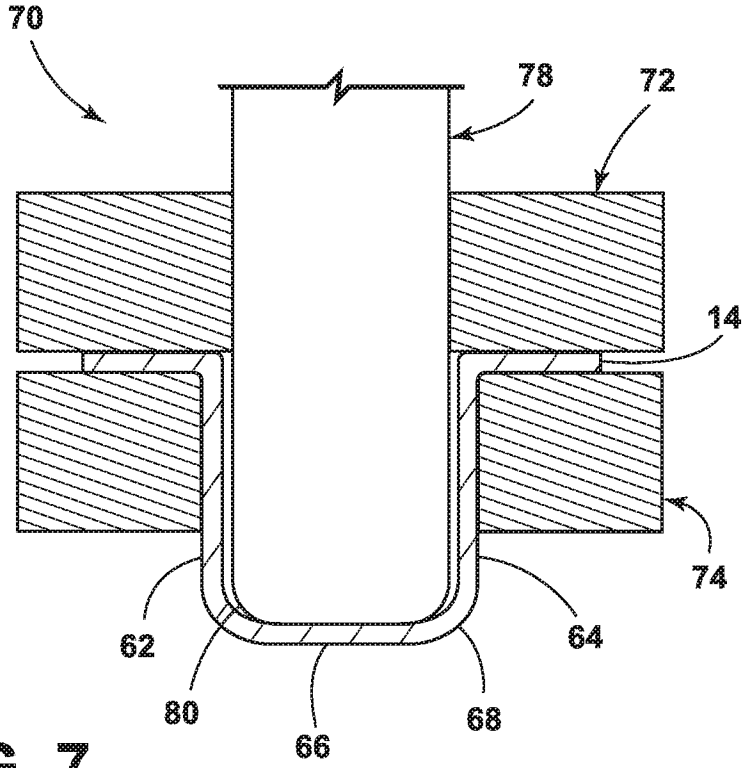
FIG. 7 is a schematic illustration of the stamping press of FIG. 6, showing the drawing of the blank into a die cavity by a punch to form a cup-shaped feature.
Figure 6:
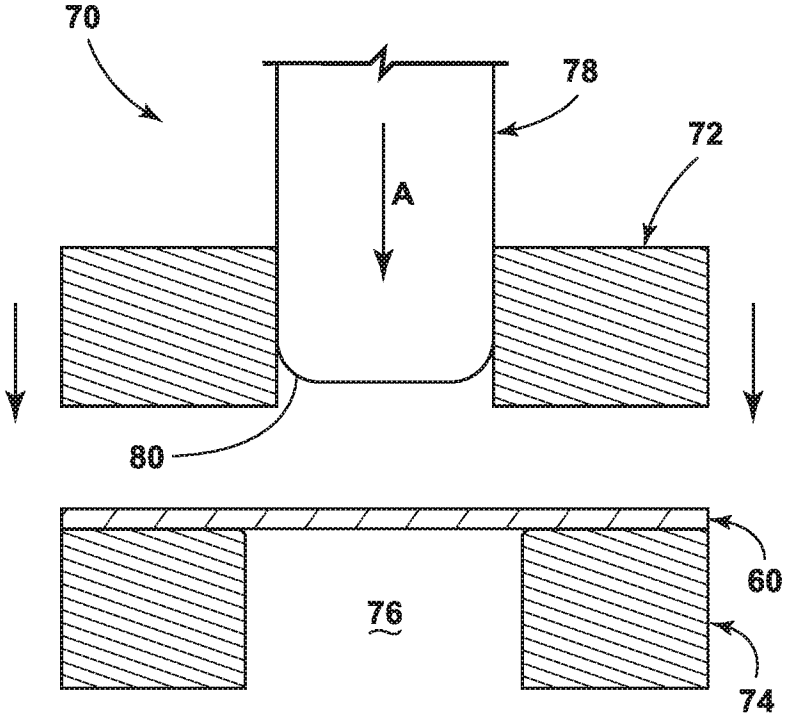
FIG. 6 is a schematic illustration of a stamping press in cross-sectional view which can be used to produce a work piece, showing the clamping of a blank between a blank holder and a stamping die.

FIGS. 6-7 is a schematic illustration of a stamping press 70 in cross-sectional view that can be used to produce the work piece 10. In one embodiment, the blank 60 is clamped between a blank holder 72 and a stamping die 74 of the press. A portion of the sheet metal blank 60 is drawn into a die cavity 76 of the stamping die 74 by a punch 78. The punch 78 can move axially, in a direction indicated by arrow A, while the blank 60 is clamped by the blank holder 72. The punch 78 forces the blank material to flow into the stamping die 74. In this manner, the cup-shaped feature 62 can be formed.

The punch 78 can have a rounded corner 80. The rounded corner 80 of punch 78 can define the top radius R1 of the cup-shaped feature 62, and can distribute the force of punch 78 around the diameter of the cup-shaped feature 62, thereby avoiding high stress concentration at the corner 68.

Returning to Figure, next, as shown at (c)-(k), the blank 60 is stamped a plurality of additional times using a plurality of successive stamping dies (not shown) to reduce the diameter of the cup-shaped feature 62 from the first diameter D1 to a second or final diameter D2. The draw direction is the same for each stamping.

Any number of successive stamping steps may be used to reduce the diameter of the cup-shaped feature 62 from the first diameter D1 to the final diameter D2, which can be the diameter of the cup-shaped feature 62 after stamping is complete and/or before further forming operations. In one embodiment, the blank 60 is stamped at least eight additional times using at least eight successive stamping dies, for a total of nine stamping or drawing steps. As shown in FIG. 4, the blank 60 can be stamped nine additional times using nine successive stamping dies, for a total of 10 stamping or drawing steps. The diameter of the cup-shaped feature 62 can be reduced by each successive stamping die. As shown, diameter of the cup-shaped feature 62 can be reduced, sequentially, from the first diameter D1, to a first reduced diameter DR1 at (c), a second reduced diameter DR2 at (d), third reduced diameter DR3 at (e), fourth reduced diameter DR4 at (f), fifth reduced diameter DR5 at (g), sixth reduced diameter DR6 at (h), seventh reduced diameter DR7 at (i), eighth reduced diameter DR8 at (j), to the final diameter D2 at (k) (i.e. D1>DR1>DR2>DR3>DR4>DR5>DR6>DR7>DR8>D2).

The diameter of the cup-shaped feature 62 can be reduced by at least 15% by each successive stamping die, alternatively by 15-22% by each successive stamping die, alternatively by at least 18% by at least some of the successive stamping dies.

Each stamping can be performed with or without a reduction in thickness of the flange 14, as compared with the original thickness T1 of the blank 60 or as compared with the thickness of the flange 14 after the previous stamping or drawing step.

During these successive stamping steps, the top radius of the cup-shaped feature 62, i.e. the inside radius of the corner 68 is reduced from the first top radius R1 to a second top radius R1. The top radius can be reduced by each successive stamping die. As shown, top radius can be reduced, sequentially, from the first top radius R1, to a first reduced top radius RR1 at (c), a second reduced top radius RR2 at (d), third reduced top radius RR3 at (e), fourth reduced top radius RR4 at (f), fifth reduced top radius RR5 at (g), sixth reduced top radius RR6 at (h), seventh reduced top radius RR7 at (i), eighth reduced top radius RR8 at (j), to the final top radius R2 at (k) (i.e. R1>RR1>RR2>RR3>RR4>RR5>RR6>RR7>RR8>R2).

During successive stamping steps, the cup-shaped feature 62 can maintain a radius at corner 69, which helps prevent the cup-shaped feature 62 from cracking, as there is less stress concentration at the corner 69. The radiused corner 69 also promotes the flow of material through the dies as the cup-shaped feature 62 is reshaped. The bottom radius R of the corner 69 can remain the same, or substantially the same, through the successive stamping steps. In one non-limiting example, bottom radius R can be about 1.5 mm±0.5 mm.

The height H of the cup-shaped feature 62 can remain consistent throughout the stamping operation, such that the cup-shaped feature 62 has the same height H after the final stamping step of the stamping operation. Alternatively, small changes in height H from the subsequent stamping steps are possible.

During these successive stamping steps, the wall thickness WT of the cup-shaped feature 62 can remain the same, or may increase. In one non-limiting example, after the first draw, the wall thickness WT can be about 1.0 mm, and after the final draw the wall thickness WT can be about 1.65 mm.

In one embodiment of the method, the stamping steps (b)-(k) are done as part of a single stamping operation in one stamping press having multiple stations and an automatic feeding system. Each stage can include a stamping die, die cavity, and plunger sized appropriately to achieve the desired dimensional change in the cup-shaped feature 62 at each stamping step.

After stamping, at (I)-(m) the cup-shaped feature 62 having the second or final diameter D2 is reformed at a forming station using cold-forging to a formed shape 82 having a thickened wall 84. The formed shape 82 can define the nut 12 of the work piece 10.

The thickened wall 84 of the formed shape 82 can have a second thickness T2 that is greater than the first thickness T1 of the blank 60. The thickened wall 84 increases the structural strength of the work piece 10 produced. The thickness T2 of the thickened wall 84 after forming can be greater than the wall thickness WT of the cup-shaped feature 62.

As shown at (I), a first forming step can include reforming the cup-shaped feature 62 into the formed shape having thickened wall 84. The additional metal for the thickened wall 84 comes from pressing the end wall 66 of the cup-shaped feature 62 closer to the flange 14, which reduces the height of the cup-shaped feature 62 by shortening the sidewall 64. This also results in a flatter and wider end 86 on the formed shape 82. The formed shape 82 accordingly has a larger diameter than the final diameter D2 of the cup-shaped feature 62. There may be little or no thinning or thickening of the end wall 66 of the cup-shaped feature 62 during the first forming step.

Reforming the cup-shaped feature 62 at (I) can include reforming a perimeter shape of the cup-shaped feature 62. In the illustrated embodiment, the circular outer surface of the tubular sidewall 64 is pressed into a hexagonal sidewall, such as by forming the hexagonal outer surface 18 of the nut 12 shown in FIG. 1. Other formed shapes for the outer surface 18 are possible.

As shown at (m), reforming the cup-shaped feature 62 at the forming station to the formed shape 82 can include piercing through the end wall 66 to form a center hole through the formed shape 82, which can complete the central opening 16. During the stamping operation, the end wall 66 of the cup-shaped feature 62 remained closed. Thus, the blank 60 is pierced by the forming operation and is not pierced by the stamping operation.

The method 40 can optionally include performing other operations on the work piece. As shown at (n), threads 17 can be applied to the central opening 16. Optionally, the central opening 16 can be resized prior to forming the threads 17. While not shown in FIG. 4, further heat treating, coating, or surface finishing operations can be performed on the formed work piece 10.

In some embodiments, the method 40 is a progressive stamping method, where the blanking, stamping, forming, and/or threading operations are performed in a progressive stamping press having an automatic feeding system. The feeding system pushes a strip of metal (as it unrolls from a coil) through all of the stations of the progressive stamping machine. Each station performs one or more operations until the work piece 10 is made. When the work piece 10 leaves the machine, it is fully formed. No secondary operations are required to work the work piece 10. However, depending on the application, subsequent heat treating, coating, or surface finishing operations can be performed to achieve desired properties, such as improving corrosion resistance, wear resistance, or hardness.

There are several advantages of the present disclosure arising from the various aspects or features of the methods, work pieces, systems, and machines described herein. For example, aspects described above provide a method of manufacturing where a blank is stamped a plurality of times using a plurality of successive stamping dies to reduce the diameter of a drawn cup-shaped feature. By using a series of stamping dies to sequentially decrease the diameter, the material can be reformed into the final shape having a thickened wall. The thickened wall increases the structural strength of the work piece produced. Among various advantages of aspects of the disclosure, it is believed that the thickened wall of the work piece strengthens and reinforces the part against contact corrosion, giving the part wider applicability since it is not limited to use with similar or compatible materials and/or mating surfaces.

Another advantage provided by aspects of the disclosure is the use of non-ferrous materials for the work piece. Embodiments of the present invention makes the use of non-ferrous materials possible by producing a non-ferrous work piece with a thickened wall. Non-ferrous materials are generally lighter and more resistant to corrosion than ferrous materials. Also, the use of non-ferrous materials allows using the cold forming processes as described herein to form the work piece 10, as ferrous materials typically require hot working.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientations.

The terms "comprising" or "comprise" are used herein in their broadest sense to mean and encompass the notions of "including," "include," "consist(ing) essentially of," and "consist(ing) of. The use of "for example," "e.g.," "such as," and "including" to list illustrative examples does not limit to only the listed examples. Thus, "for example" or "such as" means "for example, but not limited to" or "such as, but not limited to" and encompasses other similar or equivalent examples. Any reference to elements in the singular, for example, using the articles "a," "an," "the," or "said," is not to be construed as limiting the element to the singular. The term "about" as used herein serves to reasonably encompass or describe minor variations in numerical values measured by instrumental analysis or as a result of sample handling. Such minor variations may be in the order of ±0-25, ±0-10, ±0-5, or ±0-2.5, % of the numerical values. Further, The term "about" applies to both numerical values when associated with a range of values. Moreover, the term "about" may apply to numerical values even when not explicitly stated.

Generally, as used herein a hyphen "-" or dash "-" in a range of values is "to" or "through"; a ">" is "above" or "greater-than"; a "≥" is "at least" or "greater-than or equal to"; a "<" is "below" or "less-than"; and a "≤" is "at most" or "less-than or equal to."

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

The invention claimed is:

1. A method for manufacturing a work piece, comprising:

providing a non-ferrous blank having a first thickness;

stamping the blank a first time using a first stamping die to draw a portion of the blank into a cup-shaped feature having a first diameter and a first top radius, the cup-shaped feature having a tubular sidewall, a closed end wall, and a flange extending from the tubular sidewall;

stamping the blank a plurality of additional times using a plurality of successive stamping dies to reduce the diameter of the cup-shaped feature from the first diameter to a second diameter and to reduce the top radius of the cup-shaped feature from the first top radius to a second top radius; and reforming the cup-shaped feature having the second diameter at a forming station to a formed shape having a thickened wall by pressing the end wall of the cup-shaped feature closer to the flange to shorten and thicken the tubular sidewall about a perimeter of the tubular sidewall;

wherein the thickened wall of the formed shape has a second thickness that is greater than the first thickness.

2. The method of claim 1, wherein providing the non-ferrous blank comprises providing a flat sheet of non-ferrous metal.

3. The method of claim 1, wherein providing the non-ferrous blank comprises providing a circular, flat sheet of non-ferrous metal.

4. The method of claim 1, wherein the flange comprises the same thickness as first thickness of the blank.

5. The method of claim 1, wherein reforming the cup-shaped feature having the second diameter at a forming station to a formed shape comprises piercing through the closed end wall to form a hole through the formed shape.

6. The method of claim 1, wherein stamping the blank the first time comprises forming a radiused corner between the flange and the tubular sidewall of the cup-shaped feature, wherein a radius is maintained on the corner throughout stamping.

7. The method of claim 1, wherein the cup-shaped feature comprises a rounded corner between tubular sidewall and the closed end wall, the rounded corner defining the top radius.

8. The method of claim 1, wherein the top radius is a radius of a circle that is tangent to both the sidewall and the end wall of the cup-shaped feature.

9. The method of claim 1, wherein stamping the blank a plurality of additional times comprises stamping the blank at least eight additional times using at least eight successive stamping dies.

10. The method of claim 9, wherein the diameter of the cup-shaped feature is reduced by at least 15% by each successive stamping die.

11. The method of claim 10, wherein the diameter of the cup-shaped feature is reduced by at least 18% by at least some of the successive stamping dies.

12. The method of claim 1, wherein the diameter of the cup-shaped feature is reduced by at least 15% by each successive stamping die.

13. The method of claim 1, wherein the diameter of the cup-shaped feature is reduced by 15-22% by each successive stamping die.

14. The method of claim 1, wherein, after stamping the blank a first time using a first stamping die, the cup-shaped feature comprises a first height, and wherein the formed shape comprises a second height that is less than the first height.

15. The method of claim 1, wherein reforming the cup-shaped feature comprises reforming a perimeter shape of the cup-shaped feature.

16. The method of claim 1, comprising piercing through the formed shape to complete a central opening through the formed shape.

17. The method of claim 16, comprising applying threads to the central opening.

18. A method for manufacturing a work piece, comprising:

providing a non-ferrous blank having a first thickness;

stamping the blank a first time using a first stamping die to draw a portion of the blank into a cup-shaped feature having a first diameter and a first top radius, wherein the cup-shaped feature comprises a tubular sidewall and a closed end wall;

stamping the blank a plurality of additional times using a plurality of successive stamping dies to reduce the diameter of the cup-shaped feature from the first diameter to a second diameter and to reduce the top radius of the cup-shaped feature from the first top radius to a second top radius; and reforming the cup-shaped feature having the second diameter at a forming station to a formed shape having a thickened wall;

wherein the thickened wall of the formed shape has a second thickness that is greater than the first thickness;

wherein reforming the cup-shaped feature having the second diameter at a forming station to a formed shape comprises piercing through the closed end wall to form a hole through the formed shape; and wherein reforming the cup-shaped feature having the second diameter at a forming station to a formed shape comprises reforming the tubular sidewall into a hexagonal sidewall.

19. The method of claim 18, comprising applying threads on an inner surface of the hexagonal sidewall.

20. A method for manufacturing a work piece, comprising:

providing a non-ferrous blank having a first thickness;

stamping the blank a first time using a first stamping die to draw a portion of the blank into a cup-shaped feature having a first diameter and a first top radius, the cup-shaped feature having a tubular sidewall, a closed end wall, and a flange extending from the tubular sidewall;

stamping the blank at least eight additional times using at least eight successive stamping dies to reduce the diameter of the cup-shaped feature from the first diameter to a second diameter and to reduce the top radius of the cup-shaped feature from the first top radius to a second top radius, wherein the diameter of the cup-shaped feature is reduced by at least 15% by each successive stamping die; and reforming the cup-shaped feature having the second diameter at a forming station to a formed shape having a thickened wall by pressing the end wall of the cup-shaped feature closer to the flange to shorten and thicken the tubular sidewall about a perimeter of the tubular sidewall;

wherein the thickened wall of the formed shape has a second thickness that is greater than the first thickness.

21. The method of claim 20, wherein the diameter of the cup-shaped feature is reduced by at least 18% by at least some of the successive stamping dies.

22. The method of claim 20, wherein the diameter of the cup-shaped feature is reduced by 15-22% by each successive stamping die.

23. The method of claim 20, wherein the cup-shaped feature comprises a rounded corner between tubular sidewall and the closed end wall, the rounded corner defining the top radius.

24. The method of claim 23, wherein stamping the blank the first time comprises:

forming a corner between the flange and the tubular sidewall of the cup-shaped feature, wherein a radius is maintained on the corner throughout stamping.

25. The method of claim 20, wherein reforming the cup-shaped feature comprises reforming a perimeter shape of the cup-shaped feature, reducing a height of the cup-shaped feature, and piercing through the formed shape to complete a central opening through the formed shape.

* * * * *